United States Patent [19]

Kaneko

[11] 4,095,410

[45] Jun. 20, 1978

[54] ALARM ELECTRONIC TIMEPIECE

[75] Inventor: Noboru Kaneko, Tokyo, Japan

[73] Assignee: Kabushiki Kaisha Daini Seikosha, Japan

[21] Appl. No.: 732,030

[22] Filed: Oct. 13, 1976

[30] Foreign Application Priority Data

Oct. 13, 1975 Japan ..... 50-123008

[51] Int. Cl.[2] ..... G04C 21/00

[52] U.S. Cl. ..... 58/38 R; 58/57.5; 58/152 B

[58] Field of Search ..... 58/21.13, 38 R, 23 R, 58/152 B

[56] References Cited

U.S. PATENT DOCUMENTS

| | | | |
|---|---|---|---|
| 3,937,004 | 2/1976 | Natori et al. | 58/152 B |
| 3,946,549 | 3/1976 | Cake | 58/38 R |
| 3,949,240 | 4/1976 | Saito et al. | 58/152 B |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

An electronic timepiece having a time alarm. The timepiece includes a time counter circuit for developing a progressively increasing count representative of time. A single alarm counter and a repeat alarm counter both store respective counts representative of respective times. The single alarm counter is responsive to a reset signal for clearing the count stored therein. A coincidence detecting circuit compares the respective counts stored in the single and repeat alarm counter circuits with the count developed by the time counting circuit, and develops an output signal when the compared counts coincide. An alarm responds to this output signal to indicate when the time represented by the compared counts coincide. A gate circuit is effective for alternately applying the respective counts stored in the alarm counter circuits to the coincidence detecting circuit to alternately compare the count developed by the time counter circuit with the respective counts stored in the alarm counter circuits. The gate circuit applies the coincidence detecting circuit output signal as a reset signal to reset the single alarm counter circuit when the count developed by the time counting circuit coincides with the count stored in the single alarm counter circuit.

4 Claims, 3 Drawing Figures

ALARM ELECTRONIC TIMEPIECE

BACKGROUND OF THE INVENTION

This invention relates to an alarm electronic timepiece having a multi-alarm function, having two channels, wherein one of them relates to a single alarm circuit, and the other channel relates to a repeat alarm circuit. The channels are separately provided and independent of each other.

In the conventional alarm timepiece, a single alarm for operating at a predetermined time and for not operating alarm at the next occurrence of the predetermined time is preferable for use at different predetermined times. However, it is difficult to usually operate to develop an alarm signal at the same predetermined time every day. On the other hand, a repeat alarm function for repeatedly operating an alarm signal at the same predetermined time is very convenient, however it is necessary to reset the memorized contents of the alarm circuit for use to only one time.

SUMMARY OF THE INVENTION

This invention aims to eliminate the above noted difficulty and insufficiency, and the object of the present invention is to provide in a timepiece an alarm function having single alarm and repeat alarm circuits, namely two alarm channels.

DESCRIPTION OF THE PREFERRED EMBODIMENT

Figure 1:
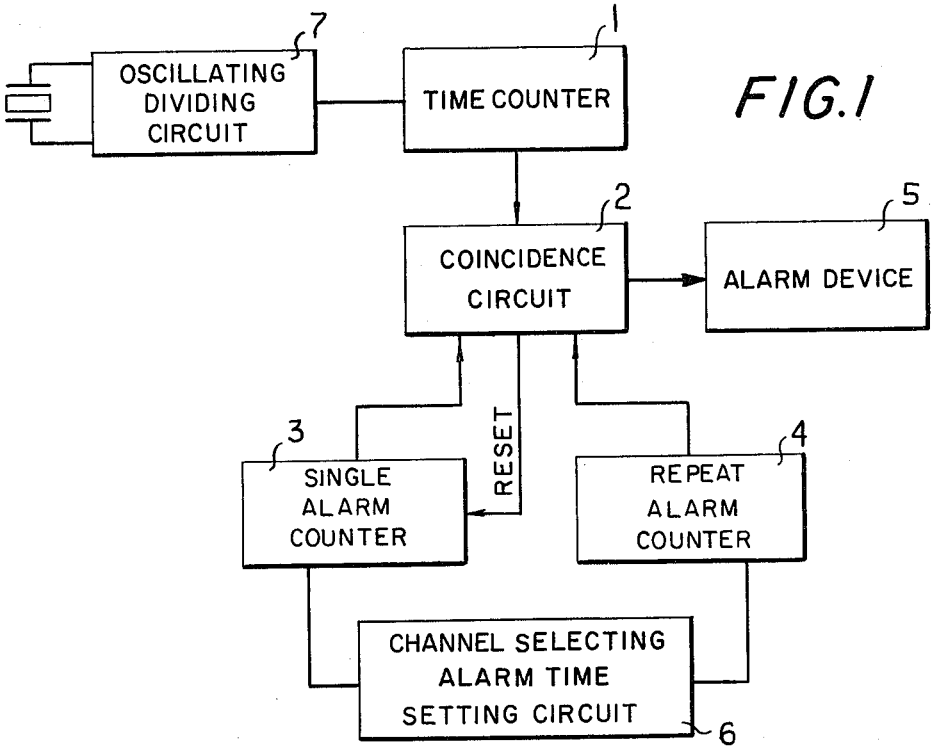
FIG. 1 shows a block diagram of the alarm electronic timepiece of the present invention.

FIG. 1 shows a circuit block diagram of the present invention. The alarm electronic timepiece is composed of a time counter 1, a coincidence circuit 2 for applying an alarm signal to an alarm device 5 when the time information of said time counter 1 coincides with present alarm time information of a single alarm counter 3 and repeat alarm counter 4, and a channel selecting alarm time setting circuit 6 for selecting one of said alarm counters 3 and 4 and setting the alarm time of one of said alarm counters 3 and 4. Said alarm device 5 is composed of a buzzer or light emitting diode or liquid crystal.

Referring now to the operation of the present invention:

Said alarm device 5 is operated when the time information of said time counter 1 operated by a 1Hz signal from the oscillating dividing circuit 7, coincides with the time information of said alarm counters 3 and 4. When the time information of said single alarm counter 3 coincides with the time information of said time counter 1, said single alarm counter 3 is reset by the coincidence output from said coincidence circuit 2, whereby the alarm time is no longer set in said single alarm counter 3 after the set time has elapsed. Namely said single alarm counter 3 is a single alarm means, not a repeating type alarm. When the time information of said repeat alarm counter 4 coincides with the time information of said time counter 1, the reset input signal is not applied to said single alarm counter 3 so that the single alarm counter 3 is not reset. Further the reset input signal is not applied to said repeat alarm counter 4, whereby said repeat alarm counter 4 is not reset. The repeat alarm counter 4 will not be reset unless an external reset signal is applied thereto, and therefore the alarm signal is generated by said alarm device whenever the set time occurs.

Said single alarm counter 3 and repeat alarm counter 4 respectively define different channels. The channels are selected by said channel selecting circuit 6, whereby it is possible to set the alarm time according to which of said channels is selected namely said single alarm counter 3 and repeat alarm counter 4 respectively.

According to the present invention, it is possible to separately mount said single alarm counter and repeat alarm counter as two channels, whereby it is possible to make a convenient watch having two channels.

Figure 2:
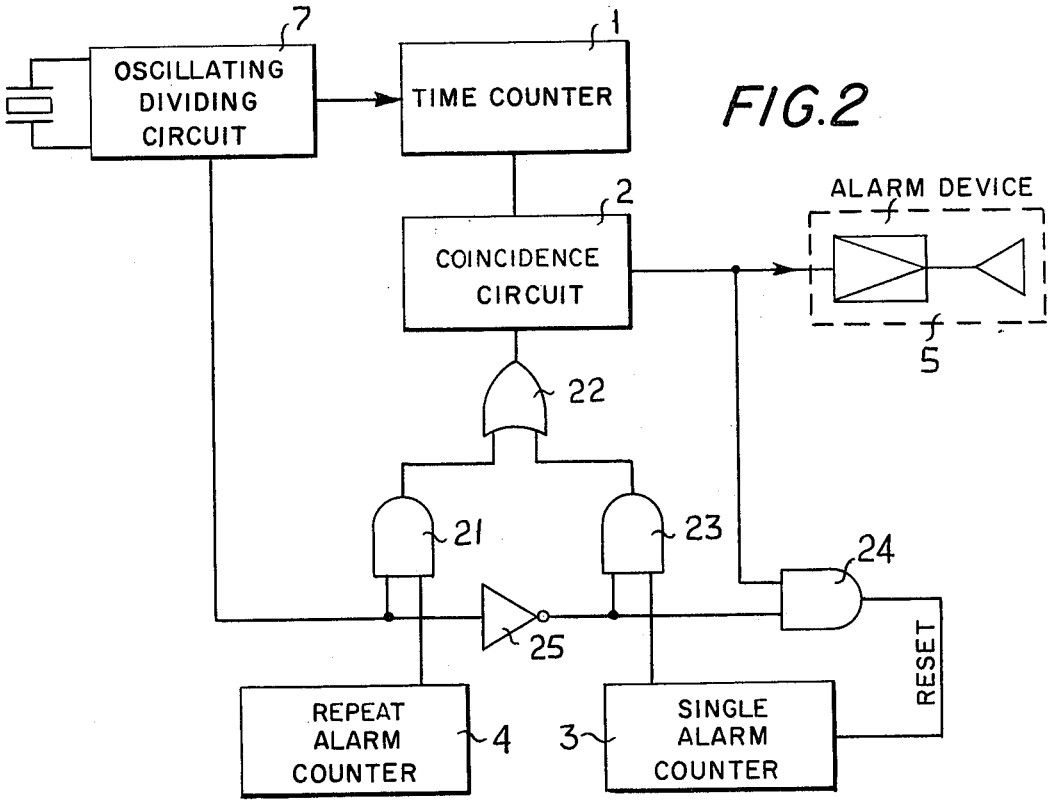
FIG. 2 shows details of gate circuitry used in the timepiece illustrated in FIG. 1.

FIG. 2 shows the detailed structure of the embodiment, illustrated in FIG. 1. A 32 Hz signal as a clock pulse is generated from the oscillating dividing circuit 7. The comparison between the single alarm counter 3, the repeat alarm counter 4 and the time counter 1 is operated every 31 milliseconds. At this time the contents of said counters 3 and 4 are alternately compared with the contents of said time counter 1 by the inverter 25. When said 32 Hz pulse signal is applied to the AND-gate 21, said AND-gate 21 becomes ON whereby a signal is applied to said coincidence circuit 2 via OR-gate 22, the contents of said time counter 1 and counter 4 are compared, and an alarm is generated by the output applied from said coincidence circuit 2 to the alarm device only when the times coincide. At this time, a zero level signal is applied to AND-gate 24 by the inverter 25, whereby the reset pulse is not applied to said single alarm counter 3, and the memorized contents in said counter 3 is not reset. Further, a pulse signal having a phase opposite to that of the clock pulse of said oscillating dividing circuit 7 is applied to AND-gate 23, and said AND-gate 23 becomes ON when and the contents of the pulse is "1," said time counter 1 and the counter 3 are compared via said OR-gate 22.

The output signal is generated from said coincidence circuit 2 when the contents of said counter 3 and time counter 1 coincide, whereby said alarm device 5 is operated. The signal level "1" from said inverter 25 and the signal level "1" of said coinciding circuit 2 are applied to said AND-gate 24 whereby the output of said AND-gate becomes "1", and is the reset signal applied to said counter 3.

Figure 3:
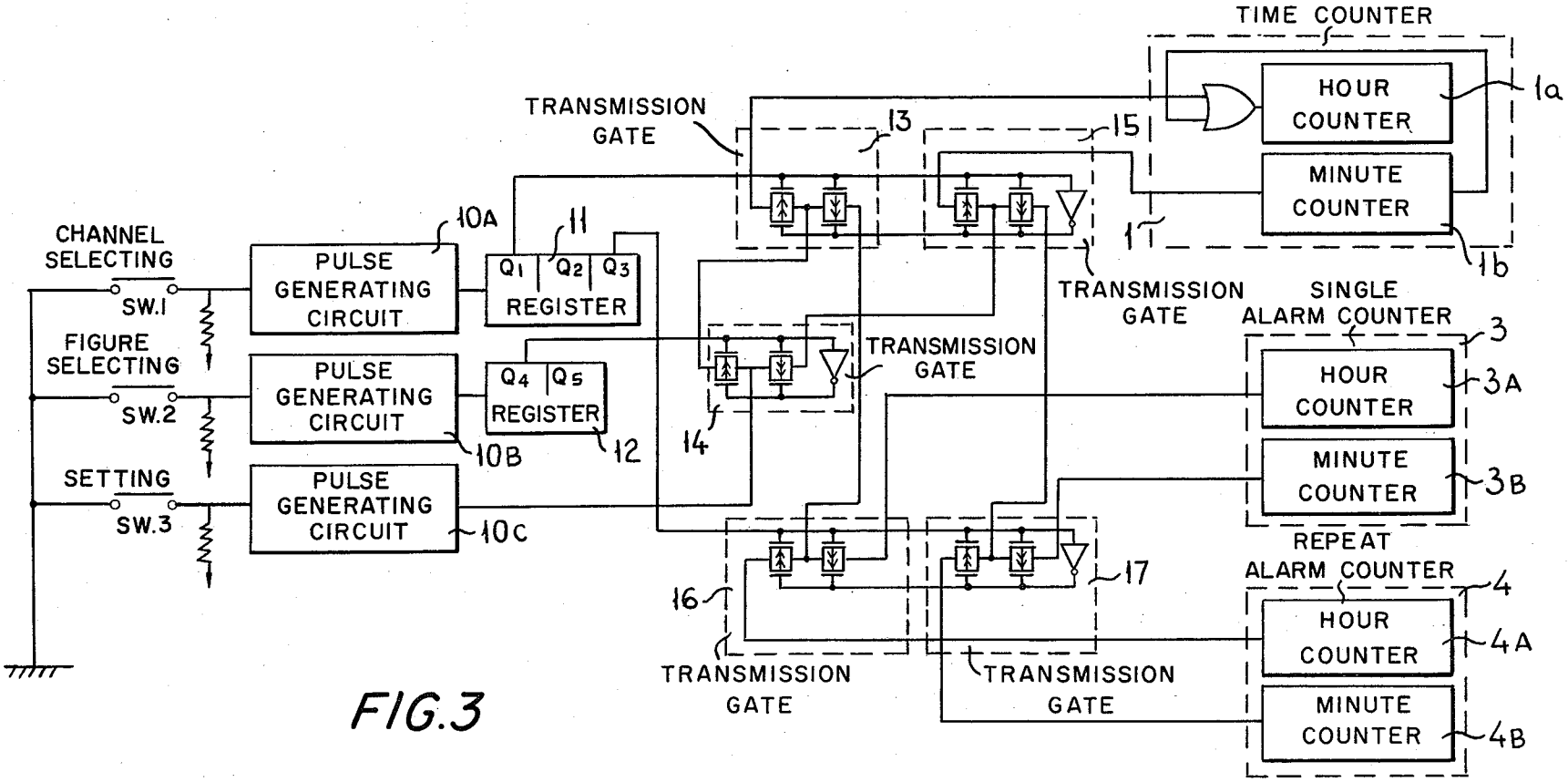
FIG. 3 shows details of setting circuitry used in the timepiece illustrated in FIG. 1.

Further, FIG. 3, shows the detailed circuit structure of the channel selecting and alarm time setting circuits.

Said circuit is composed of said time counter 1, $SW_1$ for selecting said single alarm counter 3 and repeat alarm counter 4, and $SW_2$ and $SW_3$ for amending or setting the time of each of the counters 3 and 4. The pulse generating circuits 10A, 10B and 10C for generating the pulse signal when said switches $SW_1$, $SW_2$ and $SW_3$ are closed are connected to said switches $SW_1$, $SW_2$ and $SW_3$ for amending or setting the time of said counters 3 and 4.

The registers 11 and 12 are respectively connected to said pulse generating circuits 10A and 10B, and said registers 11 and 12 are said pulse generating circuit 10c and respectively connected to the transmission-gates 13–17.

Referring now to the operation of the circuit construction in FIG. 3, the pulse signal from $Q_1$ of said register 11 is "1" when said time counter 1 is selected by the channel selecting operation, and the transmission gates 13 and 15 corresponding to the hour and minute counters 1*a* and 1*b* of said time counter 1 become ON. When the channel selecting switch $SW_1$ is operated to the ON-position, a pulse signal is generated from said pulse generating circuit 10A, and the memorized contents of said register 11 is shifted by said pulse signal whereby the output $Q_1$ becomes "1." Said transmission gates 13 and 15 are respectively connected to the transmission-gates 16 and 17, and at this time $Q_3$ is "0." The transmission-gate 16 is connected to the hour counter 3A of said single alarm counter 3, and the transmission-gate 17 is connected to the minute counter 3B of said counter 3.

When the figure selecting switch $SW_2$ selects the hour, the output $Q_4$ of said register 12 is "1," and said transmission-gate 14 is connected to said transmission-gate 13. Said transmission-gate 13 is connected to said transmission-gate 16 whereby said hour counter 3A of said single alarm counter 3 is set by the setting switch $SW_3$ via said transmission-gates 13, 14 and 16.

When said figure selecting switch $SW_2$ is pushed, the output $Q_4$ of said register 12 becomes 0, and said transmission gate 14 is connected to said transmission-gate 15. Further said transmission-gate 15 is connected to said transmission-gate 17 whereby the minute counter 3B of said single alarm counter 3 is selected, and the contents of said minute counter 3B is set by said setting switch $SW_3$.

When said channel selecting switch $SW_1$ is operated, the output $Q_1$ becomes "0," the output $Q_3$ becomes "1" whereby said transmission gate selects said repeat alarm counter 4, and the minute and hour of contents said repeat alarm counter 4 are set in the same ways as those of said single alarm counter 3. Therefore, it is possible to respectively set the alarm time for said single and repeat alarm counters 3 and 4.

I claim:

1. An alarm electronic timepiece, comprising in combination:

means for generating a high frequency time standard signal;

divider means receptive of the time standard signal for dividing the same and for developing a low frequency output signal having a frequency defining a rate of advance of time;

counting means receptive of and responsive to the divider means output signal for developing a progressively increasing count representative of time;

single alarm counter means for storing thereing a count representative of a time and responsive to a reset signal for clearing the count stored therein;

repeat alarm counter means for storing therein a count representative of a time;

coincidence detecting means for comparing the respective counts stored in said single and said repeat alarm counter means with the count developed by said counting means and for developing an output signal when the compared counts coincide;

an alarm enabled by the coincidence detecting means output signal for indicating when the time represented by the count developed by said counting means coincides with a time representated by a count stored in a respective one of said alarm counter means; and gate means for alternately applying the respective counts stored in said alarm counter means to said coincidence detecting means to alternately compare the count developed by said counting means with the respective counts stored in said alarm counter means for applying the coincidence detecting means output signal as a reset signal to reset said single alarm counter means when the count developed by said counting means coincides with the count stored in said single alarm counter means.

2. An alarm electronic timepiece according to claim 1, further comprises setting means for independently setting the respective counts stored in said single and said repeat alarm counter means.

3. An alarm electronic timepiece according to claim 1, wherein said gate means is comprised of a first AND gate responsive to an enabling signal for applying the count stored in said repeat alarm counter means to said coincidence detecting means; a second AND gate responsive to another enabling signal for applying the count stored in said single alarm counter means to said coincidence detecting means; an inverter receptive of the first-mentioned enabling signal for inverting the same and for applying the inverted enabling signal as the other enabling signal to said second AND gate thereby to alternately enable said first and said second AND gates for alternately applying the respective counts stored in said alarm counter means to said coincidence means; and a third AND gate receptive of the output signal of said coincidence detecting means and the other enabling signal for applying the output signal of said coincidence detecting means as a reset signal to said single alarm counter means to clear the contents thereof after the count developed by said counting means and the count stored in said single alarm counter means coincide.

4. An alarm electronic timepiece according to claim 3, wherein said divider means develops said first-mentioned enabling signal.

* * * * *